United States Patent [19]

Bock

[11] 4,392,027

[45] Jul. 5, 1983

[54] METHOD AND APPARATUS FOR PROVIDING A UNIFORM SOUND DISTRIBUTION IN AN AIRCRAFT CABIN

[75] Inventor: Thomas-Mathias Bock, Buxtehude, Fed. Rep. of Germany

[73] Assignee: Messerschmitt-Boelkow-Blohm Gesellschaft mit beschraenkter Haftung, Munich, Fed. Rep. of Germany

[21] Appl. No.: 277,650

[22] Filed: Jun. 26, 1981

Related U.S. Application Data

[63] Continuation-in-part of Ser. No. 35,014, May 1, 1979.

[30] Foreign Application Priority Data

May 5, 1978 [DE] Fed. Rep. of Germany ..... 2819615

[51] Int. Cl.[3] ..... H04R 9/04

[52] U.S. Cl. ..... 179/181 W; 179/1 VE

[58] Field of Search ..... 179/181 W, 110 A, 110 R, 179/115 R, 111 R, 1 VE; 181/144

[56] References Cited

U.S. PATENT DOCUMENTS

| | | | |
|---|---|---|---|
| 1,628,230 | 5/1927 | Coburn et al. | 179/1 VE |
| 2,172,066 | 9/1939 | Logsdon | 179/1 VE |
| 2,341,275 | 2/1944 | Holland | 179/181 W |
| 3,311,712 | 3/1967 | Cain | 179/181 W |
| 3,347,335 | 10/1967 | Watters et al. | 179/181 W |
| 3,423,543 | 1/1969 | Kompanek | 179/181 W |
| 3,449,531 | 6/1969 | Ashworth | 179/181 W |
| 3,636,281 | 1/1972 | Cozart | 179/181 W |
| 3,728,497 | 4/1973 | Komatsu | 179/181 W |
| 3,792,204 | 2/1974 | Murayama et al. | 179/110 A |

FOREIGN PATENT DOCUMENTS

| | | | |
|---|---|---|---|
| 1447588 | 8/1976 | United Kingdom | 179/181 W |

*Primary Examiner*—Gerald L. Brigance

*Attorney, Agent, or Firm*—W. G. Fasse; D. H. Kane, Jr.

[57] ABSTRACT

Sound is uniformly distributed in a confined space such as the passenger cabin of an aircraft by connecting an acoustic drive member to an entire wall panel or to an entire ceiling panel of the cabin structure whereby such panels act as the membrane of a loudspeaker. By properly spacing the membrane panels the entire cabin space is filled with sound in stereophonic fashion, whereby the seating arrangement becomes independent of the loudspeaker locations and vice versa.

7 Claims, 2 Drawing Figures

Figure 1:
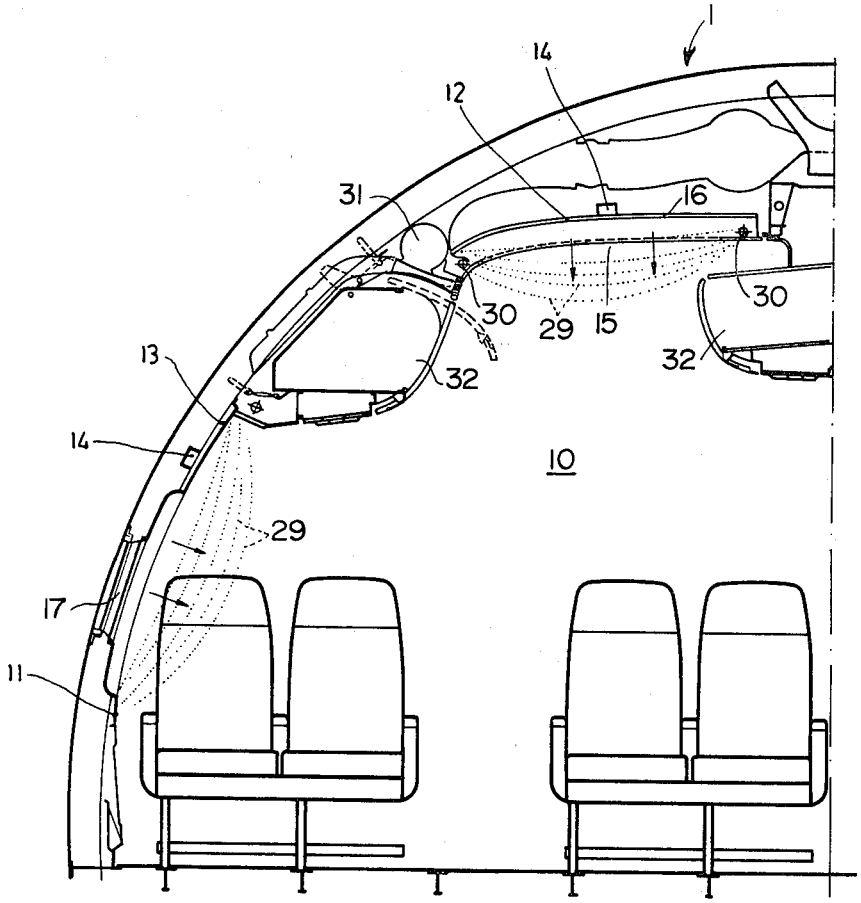

METHOD AND APPARATUS FOR PROVIDING A UNIFORM SOUND DISTRIBUTION IN AN AIRCRAFT CABIN

CROSS-REFERENCE TO RELATED APPLICATION

The present application is a Continuation-In-Part application of my copending U.S. Ser. No. 035,014; filed on May 1, 1979, which is based on German Serial Number: P 2,819,615 filed in the Federal Republic of Germany on May 5, 1978. The priority of the German filing date is claimed through the parent case: U.S. Ser. No.: 035,014.

BACKGROUND OF THE INVENTION

The present invention relates to a method and apparatus for providing a uniform sound distribution in a confined space, such as in the cabin of an aircraft or of a space craft. Heretofore it was customary to equip aircraft cabins or the like with a relatively high number of individual loudspeakers for maintaining an adequate cabin public address system. However, the sound radiation of loudspeakers is a point type source radiation which means that individual rows of seats will receive a sound saturation which is too loud or too large, whereas other areas in the cabin will not be reached sufficiently. In addition, the arrangement of the special loudspeakers depends on the grouping of the seat rows and requires that openings be cut into the internal wall covering of the cabin.

German Patent Publication (DOS) 1,572,503 discloses a reverberating or echo chamber which is provided with flexible wall components for simulating predetermined sound fields. The wall components are adjustable in their position by special adjustment devices, whereby the outer and inner wall panels of the wall components are flexible. The space between the wall panels is filled with a liquid.

The just described structure is not suitable for aircraft and spacecraft for several reasons. First, the structure is much too expensive. Secondly, the necessary stiffness or rigidity is not available and third, the weight of the cell would be unfeasibly high. German Patent Publication (DOS) 1,572,460 discloses an electronic instrument for the replay of music and speech. The known apparatus comprises a sound wall of synthetic material known as a so-called electro-molecular material. Further, the known apparatus comprises frequency conductors in the shape of sound tubes which are closed relative to the environmental air. This type of structure is also not suitable for aircraft and spacecraft because the manufacturing costs as well as the weight are too large. Besides, it would be necessary to manufacture special elements only for the so-called public address system, whereby the prior art would not be substantially improved.

OBJECTS OF THE INVENTION

In view of the above it is the aim of the invention to achieve the following objects singly or in combination:

To provide a public address and sound distribution system especially for an enclosed space such as an aircraft cabin or a spacecraft cabin to assure a uniform sound distribution without the need of additional structural components;

to utilize the space enclosing wall panels directly as the diaphragm or membrane of a loudspeaker; and to avoid the use of so-called papier-mache diaphragms as they have been used heretofore in loudspeaker systems.

SUMMARY OF THE INVENTION

The sound distribution system according to the invention utilizes portions of the inner wall covering directly as a loudspeaker diaphragm by operatively connecting these wall panels to an acoustical driving motor such as a dynamic drive motor comprising a magnet and a moving coil, whereby these panel components function as such and simultaneously as the loudspeaker diaphragm. Such wall components are of a lightweight type of structure in the form of honeycomb or sandwich panels.

The wall panels and/or the ceiling panels which are driven by an acoustic motor will be arranged in such a manner relative to the size and shape of the cabin such as the passenger cabin that a uniform sound distribution is assured throughout the enclosed space.

BRIEF FIGURE DESCRIPTION

Figure 2:
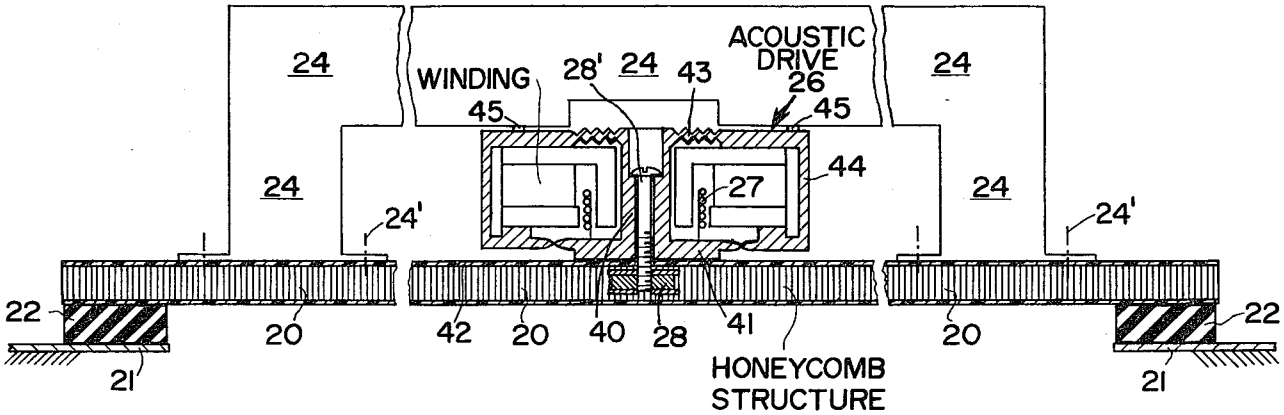

In order that the invention may be clearly understood, it will now be described, by way of example, with reference to the accompanying drawings, wherein:

FIG. 1 is a view into a quarter section of an aircraft cabin with the view direction extending in the direction of the longitudinal axis of the aircraft; and FIG. 2 shows an enlarged view of one embodiment for securing a wall panel to the aircraft frame structure and to an acoustic drive motor.

DETAILED DESCRIPTION OF PREFERRED EXAMPLE EMBODIMENTS AND OF THE BEST MODE OF THE INVENTION

FIG. 1 shows a view into a quarter section of an aircraft passenger cabin 10. The inwardly facing surface of the fuselage or frame 1 is covered with wall covering elements 11 comprising a plurality of covering panels such as wall panels 13 and ceiling panels 12. The ceiling panels 12 may, for example, be formed as so-called honeycomb lightweight structures which are known as such and have a facing surface 15 as well as a back surface 16 with a conventional honeycomb structure therebetween. The panels may also be made as so-called sandwich type panels which are also conventional. A conventional window 17 extends through the wall of the aircraft frame or fuselage 1. According to the invention certain wall panels and/or ceiling panels are operatively connected to acoustical drive motors 14 so that the respective entire panel can operate as a loudspeaker diaphragm or membrane.

Conventional wall panels of the described structure are sufficiently light and stable to act as such diaphragms. By using an entire wall panel 13 and/or an entire ceiling panel 12 as a loudspeaker diaphragm, the invention avoids the cutting of holes into the wall and ceiling panels for the insertion of conventional loudspeakers. Thus, the invention also reduces the dead weight of an aircraft or spacecraft because fewer acoustical drive motors may now be used in a more efficient manner.

It is critical for the proper operation of the invention that the wall and/or ceiling panels which are to operate as a loudspeaker membrane are secured to the frame structure in a manner which will enable such double function. FIG. 2 shows one example embodiment.

In FIG. 2 the wall or ceiling panel 20 of conventional construction is secured to the frame 21 of a space enclosing structure such as an aircraft cabin by rubber elastic members 22. The members 22 make sure that the panel 20 is able to move in response to the drive exerted on the panel by an acoustical drive motor 26. The moving coil system 27 is operatively secured to the panel at 28. As shown, the acoustical drive motor 26 is preferably secured to the panel side facing away from the aircraft or spacecraft cabin.

It will be appreciated, that many modifications are possible for securing a wall or ceiling panel in the intended manner. For example, the spacer members 22 could be of the so-called shock-mount-type elastically yielding to the extent necessary for a loudspeaker diaphragm action.

In this embodiment the acoustic motor remains stationary due to its own mass and thus serves as the fixed part of a conventional loudspeaker system, in said embodiment the panel is made to oscillate by the motor and consequently serves as a loudspeaker diaphragm. According to a further embodiment of the invention the mass of the motor is secured to a rigid bracket 24 which, at its respective extremities, is fixed to the panel close to the edges of the same and thus forms a gantry type of structure for securing the mass of the loudspeaker system or driver means 26 substantially to the panel edges. The securing is preferably effected by means of bolted connections. The invention takes advantage in a surprisingly simple manner, of the structural and weight characteristics of the panels forming wall or ceiling covering units. Due to their sandwich and/or honeycomb structure these panels are ideally suitable for the intended purpose because they also have a uniform sound distribution characteristic as indicated by the dotted lines 29 in FIG. 1.

The distribution and number of panels which are driven by an acoustic motor will depend on the particular requirement in order to achieve a uniform sound distribution throughout the space confined by the wall and ceiling panels. Depending on the size of the space to be uniformly filled with sound, it may be sufficient to provide just a few ceiling panels 12 with the acoustic motor 14. Similarly, it may be sufficient to provide only a certain number of wall panels 13 with an acoustic drive motor. However, the combination of acoustically driven wall and ceiling panels is also contemplated.

Further advantages of the invention are seen in that the so-called utility channel 31 and light baggage space 32 are increased because the invention obviates the numerous individual loudspeakers used heretofore. Further, the invention results in a corresponding saving or reduction in the number of acoustic drive systems. By achieving a more uniform sound distribution, the seats may also be distributed so as to use the available floor space more efficiently. By avoiding the use of conventional loudspeaker diaphragms their drawbacks such as moisture sensitivity and flammability are also avoided.

The drive systems are also better protected according to the invention because the panels themselves are not provided with any loudspeaker holes which incidentally helps keeping dust from entering into the loudspeaker system and facilitates the cleaning of the wall and/or ceiling panels.

Any kind of acoustical drive system may be used for the purpose of the invention. For example, a piezoelectric drive system could be used instead of the electrodynamic one as mentioned in the foregoing.

Referring again to FIG. 2, the connecting means shown at 28 between the drive system 26 and the panel 20 comprising a threaded insert 28 embedded centrally in the panel 20 and a threaded bolt 28'. The drive member of the moving coil system 27 comprises a mushroom type head 41 contacting the panel 20 at a surface contact area 42 and a stem 40 through which the bolt 28' extends axially. The foot of the steam 40 is movably connected through a flexible member 43 to the housing 44 of the drive system 26. The housing 44 and thus the mass of the drive system 26 is rigidly connected, as shown at 45, to the gantry type rigid bracket 24. The bracket 24 is rigidly connected to the panel 20 at 24' substantially at the edges of the panel 20 whereby the bracket 24 has a length corresponding substantially to the width of the panel 20 as shown in FIG. 2.

Although the invention has been described with reference to specific example embodiments, it is to be understood that it is intended to cover all modifications and equivalents within the scope of the appended claims.

What is claimed is:

1. A method for the uniform distribution of sound in an aircraft or spacecraft cabin structure, comprising the following step: substantially enclosing the cabin space by a plurality of flexible structural inner wall and ceiling panel members inside an outer cabin wall, elastically connecting at least certain ones of said panel members substantially at the edges thereof to said cabin structure to provide a movable support enabling the respective panel member to vibrate, centrally connecting an acoustic drive member of acoustic drive means including said drive member and a mass, said drive member being movable relative to said mass, to said certain panel members in such a manner that the drive member is connected to the respective panel member intermediate of the panel edges on a surface area contact, and that the mass of the drive means is rigidly secured to the same panel member substantially adjacent the edges of the same panel member, whereby the acoustic drive means are located between the outer cabin wall and the respective panel member which may vibrate as an acoustical diaphragm and whereby the cabin structure with its inner and outer wall forms a loudspeaker cabinet in which said drive means are located.

2. The method of claim 1, wherein said connecting step comprises securing said drive member and the respective mass of the drive means to that side of a panel member facing away from the cabin.

3. An aircraft or spacecraft cabin structure, comprising outer wall means, a plurality of flexible structural wall and ceiling panel members forming inner wall means, first flexible connecting means (22) operatively securing at least certain ones of said panel members at the edges thereof to said cabin structure for enabling the respective panel members to vibrate, acoustic drive means each including a mass and a drive member movable relative to the mass and having a surface area contact with the respective panel for vibrating the respective panel member of said certain panel members, second connecting means (28) in said panel member and in said drive member for centrally connecting the respective drive member to the panel member intermediate of the panel edges for introducing a driving force into the panel member through said surface area contact, and third rigid connecting means (24) operatively connecting the mass of the respective drive means to the same panel member substantially at the edges of the same panel member, whereby the respective panel member may vibrate as an acoustical diaphragm which forms part of the cabin so that said inner and outer wall means of said cabin structure form a loudspeaker cabinet in which said acoustic drive member is located.

4. The cabin of claim 3, wherein said panel members comprise a lightweight honeycomb structure.

5. The cabin of claim 3, wherein said panel members comprise a lightweight sandwich type structure.

6. The cabin of claim 3, wherein said third connecting means comprise rigid bracket means substantially bridging the respective panel member on the side thereof facing away from the cabin.

7. The cabin of claim 6, wherein said rigid bracket means form a gantry type structure.

* * * * *